US007168788B2

(12) United States Patent
Barss et al.

(10) Patent No.: US 7,168,788 B2
(45) Date of Patent: Jan. 30, 2007

(54) DROP EJECTION ASSEMBLY

(75) Inventors: Steven H. Barss, Wilmot Flat, NH (US); Paul A. Hoisington, Norwich, VT (US); John A. Higginson, Santa Clara, CA (US)

(73) Assignee: Dimatix, Inc., Lebanon, NH (US)

( * ) Notice: Subject to any disclaimer, the term of this patent is extended or adjusted under 35 U.S.C. 154(b) by 247 days.

(21) Appl. No.: 10/749,622

(22) Filed: Dec. 30, 2003

(65) Prior Publication Data

US 2005/0146560 A1 Jul. 7, 2005

(51) Int. Cl.
*B41J 2/14* (2006.01)
*B41J 2/135* (2006.01)

(52) U.S. Cl. ..... 347/47; 347/45

(58) Field of Classification Search ..... 347/47
See application file for complete search history.

(56) References Cited

U.S. PATENT DOCUMENTS 3,747,120 A 7/1973 Stemme
4,413,268 A * 11/1983 Bentin ..... 347/47
4,613,875 A 9/1986 Le et al.
5,745,129 A * 4/1998 Moriyama et al. ..... 347/12
6,041,600 A 3/2000 Silverbrook
6,132,028 A 10/2000 Su et al.
6,139,136 A * 10/2000 Mackay et al. ..... 347/85
6,235,212 B1 5/2001 Silverbrook
6,254,219 B1 * 7/2001 Agarwal et al. ..... 347/47
6,264,307 B1 7/2001 Silverbrook
6,439,695 B2 8/2002 Silverbrook
6,511,156 B1 * 1/2003 Kazama et al. ..... 347/47
6,536,874 B1 3/2003 Silverbrook
6,582,059 B2 6/2003 Silverbrook
6,957,882 B2 * 10/2005 Wouters et al. ..... 347/86

* cited by examiner

*Primary Examiner*—Vip Patel
*Assistant Examiner*—Jannelle M. Lebron
(74) *Attorney, Agent, or Firm*—Fish & Richardson P.C.

(57) ABSTRACT

A drop delivery printhead includes a well about a nozzle opening to enhance jetting performance.

40 Claims, 3 Drawing Sheets

MENISCI @ 2, 4, 6 INWG, 30 dynes/cm

DROP EJECTION ASSEMBLY

This invention relates to ejecting drops.

BACKGROUND

Ink jet printers are one type of apparatus for depositing drops on a substrate. Ink jet printers typically include an ink path from an ink supply to a nozzle path. The nozzle path terminates in a nozzle opening from which ink drops are ejected. Ink drop ejection is typically controlled by pressurizing ink in the ink path with an actuator, which may be, for example, a piezoelectric deflector, a thermal bubble jet generator, or an electrostatically deflected element. A typical print assembly has an array of ink paths with corresponding nozzle openings and associated actuators. Drop ejection from each nozzle opening can be independently controlled. In a drop-on-demand print assembly, each actuator is fired to selectively eject a drop at a specific pixel location of an image as the print assembly and a printing substrate are moved relative to one another. In high performance print assemblies, the nozzle openings typically have a diameter of 50 microns or less, e.g. around 25 microns, are separated at a pitch of 100–300 nozzles/inch, have a resolution of 100 to 3000 dpi or more, and provide drops with a volume of about 1 to 120 picoliters (pl) or less. Drop ejection frequency is typically 10 kHz or more.

Hoisington et al. U.S. Pat. No. 5,265,315, describes a print assembly that has a semiconductor body and a piezoelectric actuator. The body is made of silicon, which is etched to define ink chambers. Nozzle openings are defined by a separate nozzle plate, which is attached to the silicon body. The piezoelectric actuator has a layer of piezoelectric material, which changes geometry, or bends, in response to an applied voltage. The bending of the piezoelectric layer pressurizes ink in a pumping chamber located along the ink path. Piezoelectric ink-jet print assemblies are also described in Fishbeck et al. U.S. Pat. No. 4,825,227, Hine U.S. Pat. No. 4,937,598, Moynihan et al. U.S. Pat. No. 5,659,346 and Hoisington U.S. Pat. No. 5,757,391, the entire contents of which are hereby incorporated by reference.

SUMMARY

In an aspect, the invention features fluid drop ejection. A printhead is provided that includes a flow path in which fluid is pressurized to eject drops from a nozzle opening. The nozzle opening is disposed in a well. Fluid is supplied to the well from the nozzle opening to form a meniscus. The meniscus defines a fluid depth above the edge of the nozzle opening equal to about 1 to 15% of the nozzle opening width with the well filled with fluid.

In another aspect, the invention features a printhead with a flow path in which fluid is pressurized to eject drops from a nozzle opening. The nozzle opening is disposed in a well. The ratio of the cross-section of the well to the cross-section of the nozzle opening is about 1.4 to about 2.75. In embodiments, the ratio of the well depth to the cross-section of the nozzle opening is about 0.15 to 0.5.

In another aspect, a printhead includes a fluid flow path in which fluid is pressured to eject drops from a nozzle opening. The nozzle opening is disposed in a well. The well has a relatively long axis and a short axis.

Other aspects or embodiments may include combinations of the features in the aspects above and/or one or more of the following. The meniscus is formed by controlling the pressure at the meniscus. Forming the meniscus is performed by reducing the pressure in the fluid. A vacuum is applied at a location upstream of the nozzle opening. The vacuum at the nozzle opening is from about 0.5 to about 10 inwg (vacuum pressures herein are in inches of water gauge (inwg)).

The ratio of the well width to the nozzle opening width is from about 1.4 to about 2.8. The well has a depth of about 0.15 to 0.5 of the nozzle opening. The spacing between well perimeter and nozzle perimeter is from about 0.2 or more of the nozzle width. The fluid has a surface tension of about 20–45 dynes/cm. The nozzle opening and the well is defined by a common body. The nozzle opening and/or the well is, for example, defined in a silicon material. The nozzle opening and/or the well may also be defined in metal, carbon or plastic.

The fluid is pressurized by a piezoelectric element. The nozzle opening has a width is about 70 micron or less. The method includes a plurality of nozzle openings and the nozzle openings may have a pitch of about 25 nozzles/inch or more. The method may include ejecting drops having a volume of about 1 to about 70 pL.

Embodiments may include one or more of the following advantages. Printhead operation is robust and reliable since waste ink about the face of the nozzle plate is controlled to reduce interference with drop formation and ejection. Drop velocity and trajectory straightness is maintained in high performance printheads in which large arrays of small nozzles must accurately eject ink to precise locations on a substrate. The well structure controls waste ink and permits desirable jetting characteristics with a variety of jetting fluids, such as inks with varying viscosity or surface tension characteristics, and heads with varying pressure characteristics at the nozzle openings. The well structure itself is robust, does not require moving components, and can be implemented by etching, e.g., in a semiconductor material such as a silicon material.

Still further aspects, features, and advantages follow. For example, particular aspects include well dimensions and characteristics discussed below.

DESCRIPTION OF DRAWINGS

Like reference symbols in the various drawings indicate like elements.

DETAILED DESCRIPTION

Figure 1:
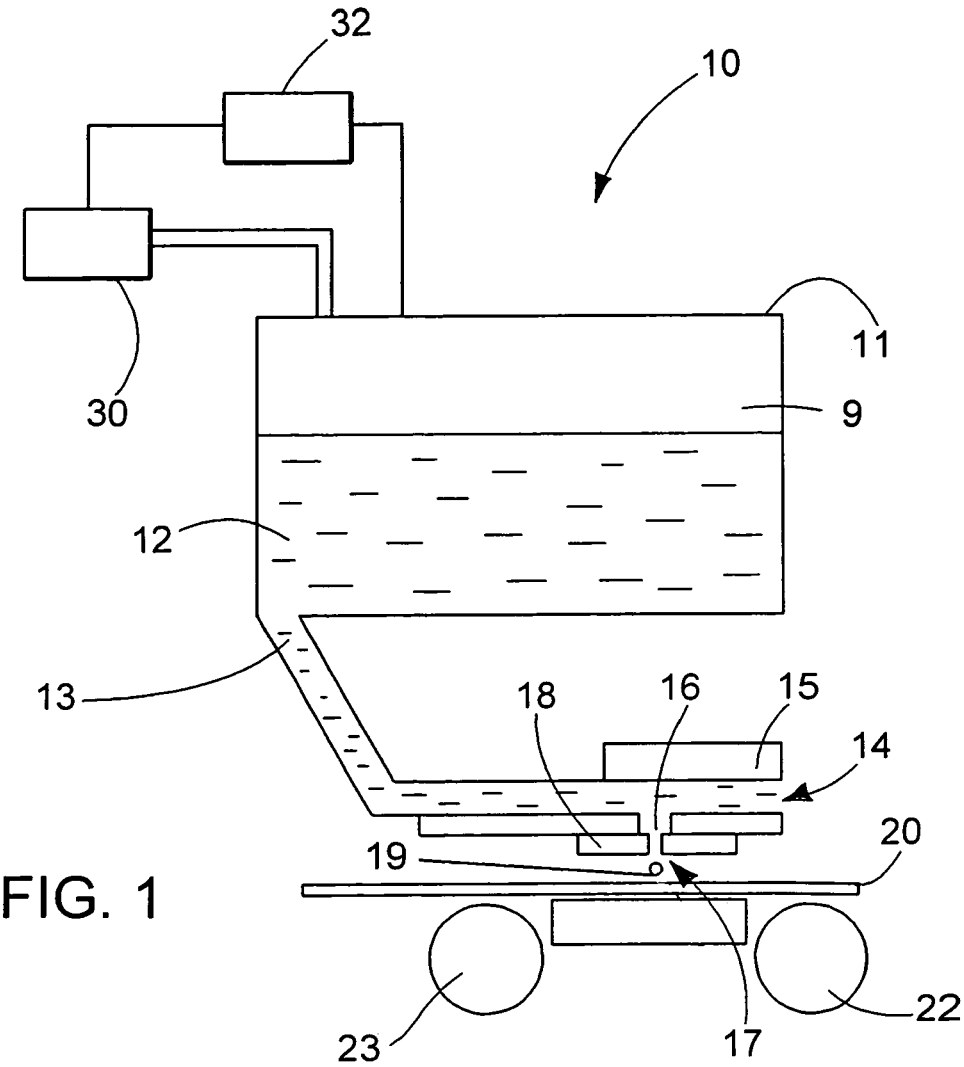
FIG. 1 is a schematic of a drop ejection assembly.

Referring to FIG. 1, an ink jet apparatus 10 includes a reservoir 11 containing a supply of ink 12 and a passage 13 leading from the reservoir 11 to a pressure chamber 14. An actuator 15, e.g., a piezoelectric transducer, covers the pressure chamber 14. The actuator is operable to force ink from the pressure chamber 14 through a passage 16 leading to a nozzle opening 17 in an nozzle plate 18, causing a drop of ink 19 to be ejected from the nozzle 17 toward a substrate 20. During operation, the ink jet apparatus 10 and the substrate 20 can be moved relative to one another. For example, the substrate can be a continuous web that is moved between rolls 22 and 23. By selective ejection of drops from an array of nozzles 17 in nozzle plate 18, a desired image is produced on substrate 20.

The ink jet apparatus also controls the operating pressure at the ink meniscus proximate the nozzle openings when the system is not ejecting drops. In the embodiment illustrated, pressure control is provided by a vacuum source 30 such as a mechanical pump that applies a vacuum to the head space 9 over the ink 12 in the reservoir 11. The vacuum is communicated through the ink to the nozzle opening 17 to prevent ink from weeping through the nozzle opening by force of gravity. A controller 32, e.g. a computer controller, monitors the vacuum over the ink in the reservoir 11 and adjusts the source 30 to maintain a desired vacuum in the reservoir. In other embodiments, a vacuum source is provided by arranging the ink reservoir below the nozzle openings to create a vacuum proximate the nozzle openings. An ink level monitor detects the level of ink, which falls as ink is consumed during a printing operation and thus increases the vacuum at the nozzles. A controller monitors the ink level and refills the reservoir from a bulk container when ink falls below a desired level to maintain vacuum within a desired operation range. In other embodiments, in which the reservoir is located far enough below the nozzles that the vacuum of the meniscus overcomes the capillary force in the nozzle, the ink can be pressurized to maintain a meniscus proximate the nozzle openings. In embodiments, the operating vacuum is maintained at about 0.5 to about 10 inwg.

During ink jetting, ink may collect on the nozzle plate 18. Over time, the ink can form puddles which cause printing errors. For example, puddles near the edge of a nozzle opening can effect the trajectory, velocity or volume of the ejected drops. Also, a puddle could become large enough so that it drips onto printing substrate 20 causing an extraneous mark. The puddle could also protrude far enough off the nozzle plate 18 surface that the printing substrate 20 comes into contact with it, causing a smear on the printing substrate 20.

Figure 1A:
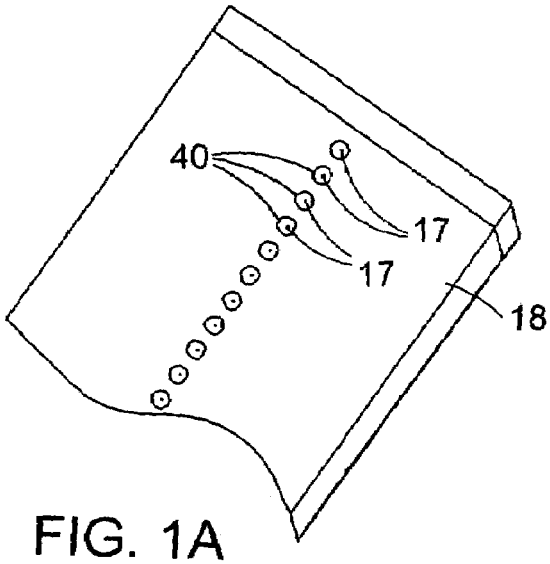
FIG. 1A is a perspective view of a nozzle plate.
Figure 1B:
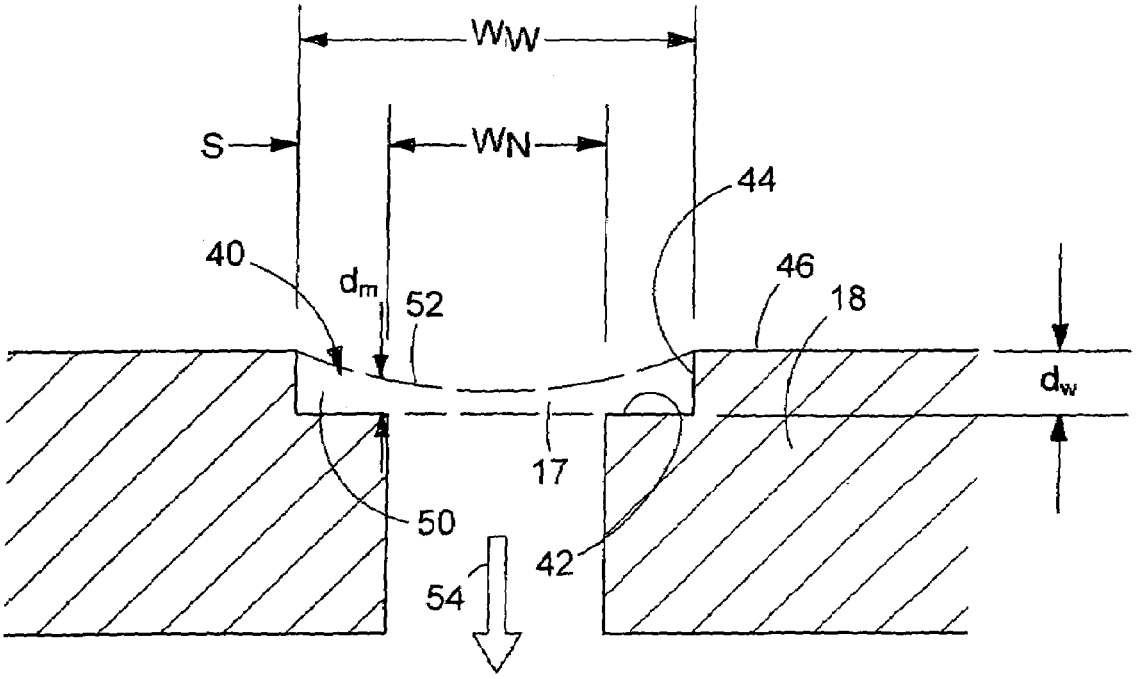
FIG. 1B is an enlarged cross section through a nozzle opening in a nozzle plate.

Referring as well to FIG. 1A, the nozzle plate 18 includes an array of closely spaced nozzle openings 17 and each nozzle opening 17 is located in a well 40. Referring as well to FIG. 1B, in the embodiment illustrated, the nozzle opening 17 is defined in and centered on the floor 42 of the well 40. The floor 42 of the well extends to the wall 44 of the well, which projects outwardly to the face 46 of the nozzle plate.

The dimensions of the well, including its width, $W_w$, its depth, $d_w$, and the spacing, S, of the well wall from the perimeter of the nozzle opening are selected to control waste ink. When ink 50 is disposed in the well, a meniscus 52 is formed. Under the conditions of the operating pressure (arrow 54), the meniscus has a depthat the edge of the nozzle opening, $d_m$, that is small compared to the nozzle width $W_n$. The predictable shape of the meniscus provides reliable jetting. The shallow depth of the meniscus provides jetting without substantially affecting the drop direction or velocity. In addition, the spacing, S, is selected to reduce the likelihood that waste ink on the face 46 of the nozzle plate 18 will influence drop formation or ejection.

Figure 2:
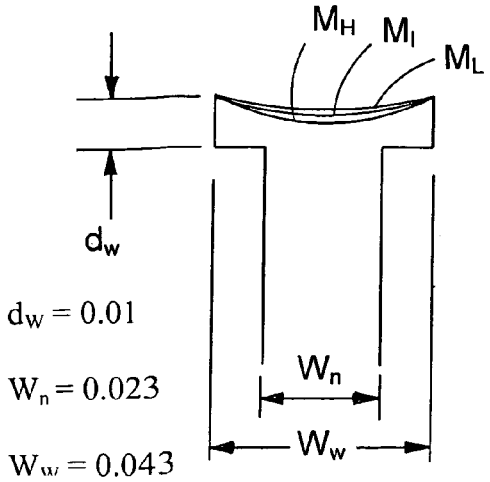
FIG. 2–2C are cross-sections through a nozzle opening in nozzle plates illustrating a meniscus under varying conditions.
Figure 2A:
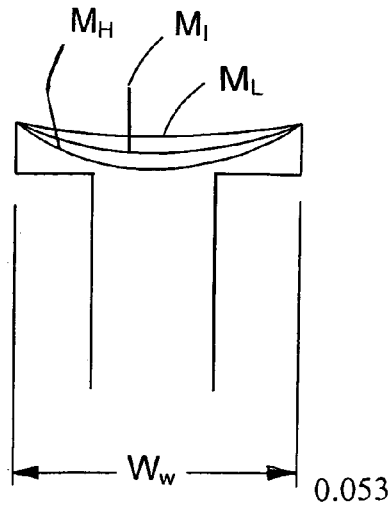
Figure 2B:
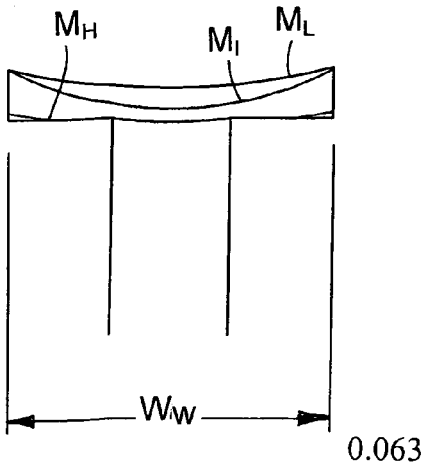
Figure 2C:
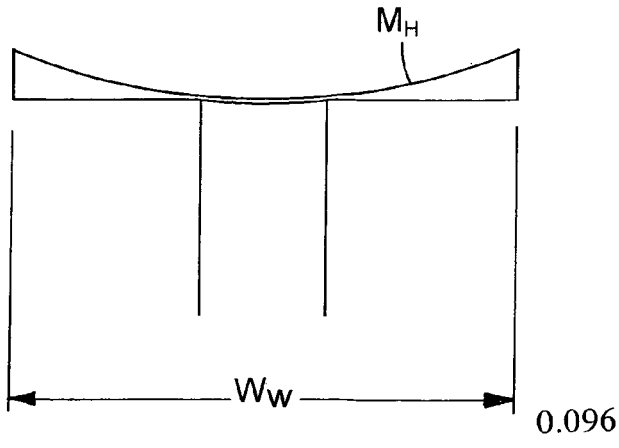

Referring to FIGS. 2–2C, the effect on the meniscus is illustrated as the well width, $W_w$, increases and the operating pressure varies. The meniscus, labeled $M_H$, $M_I$ and $M_L$, is represented at high, intermediate, and low vacuum pressure, respectively. The depth of the meniscus over the nozzle openings decreases as the well width increases. Referring particularly to FIG. 2, the meniscus is over the nozzle opening at all pressures. At high vacuum pressure, the meniscus depth is relatively shallow, which is typically desirable for jetting. At low vacuum, the meniscus depth is greater, which can result in non-optimal jetting. In this case, the depth of the well can be decreased to reduce the meniscus depth. Referring to FIG. 2A, the meniscus is at a selected depth at high and intermediate pressures and non-optimally deep at low pressure. Referring to FIG. 2B, the meniscus is at a desirable operating depth at intermediate pressure, non-optimally deep at low pressure, and non-optimally shallow at high pressure. At high vacuum pressure, the meniscus does not form over the nozzle opening. Most of the ink is drawn into the nozzle opening, while some waste ink is retained in the well. Referring to FIG. 2C, the meniscus does not form over the nozzle opening at any operating pressure. Fluid collects in the corner between the well floor and wall and extends to the perimeter of the nozzle opening. This condition is non-optimal since fluid at the perimeter of the nozzle opening can effect jetting. In FIGS. 2–2C, the curvature (radius, R) of the meniscus is calculated by R=2* surface tension/pressure. The meniscus fluid has a surface tension of 30 dynes/cm and the operating vacuum pressure is 2, 4, and 6 inwg. The dimensions are in mm.

The spacing, S, between the well wall and the perimeter of the nozzle provides a distance that reduces the likelihood that waste ink on the nozzle plate face will affect jetting. In embodiments, spacing, S, is about 20% or more, e.g. 25 to 100% of the nozzle width, $W_n$. The dimensions of the well also provide a desirable meniscus depth over the nozzle openings. In embodiments, the well provides a meniscus depth over the edge of the nozzle opening of about 1 to 15% of the nozzle width when the well is full of fluid of a given surface tension and the nozzle is within a given operating pressure. (The well is full of fluid when there is sufficient fluid to substantially cover the wall of the well.) In embodiments, the meniscus depth, measured at the edge of the nozzle is about 1 to 25% of the nozzle opening. In embodiments, the desired meniscus depth is maintained over a desired range of operating pressures. In embodiments, the operating pressure is about −0.5 to −10 inwg, e.g. about −2 to −4 or −6 inwg. In embodiments, the fluid has a surface tension of about 20 to 40 dynes/cm. The ratio of the well width to the nozzle width is about 1.4 to about 2.8, e.g. about 1.5 to about 1.7. The well depth is about 0.15 to 0.5 of the nozzle opening width. The well dimensions can also be selected to define a volume needed to accommodate a certain volume of waste ink. For noncircular nozzle openings and/or wells, e.g. asymmetric or irregular geometries, well and nozzle widths are measured at the minimum values. For wells having varying depths, the well depth is measured between the nozzle opening and the face of the nozzle plate. In embodiments, the nozzles width is about 200 micron or less, e.g. about 10 to 30 micron, the nozzle pitch is about 100 nozzles/inch or more, e.g., 300 nozzles/inch, and the drop volume is about 1 to 70 pL. In embodiments, the fluid has a viscosity of about 1 centipoise to about 40 centipoise.

Figure 3:
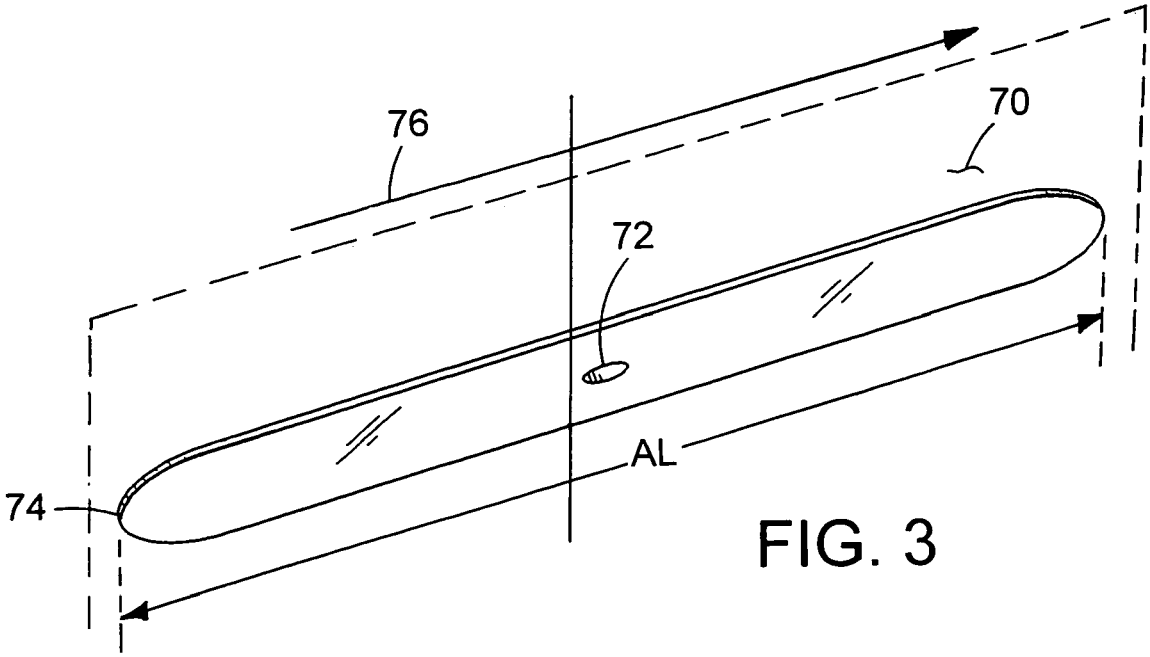
FIG. 3 is a perspective view of a nozzle well.

Referring to FIG. 3 in an embodiment, a nozzle plate 70 includes a nozzle opening 72 which is circular, and a well 74, which is an oval. The major axis, $A_L$, of the oval is arranged along a direction (arrow 76) in which the nozzle face can be wiped or washed in a manual or mechanical cleaning operation. The oval well collects debris along the length of its major axis $A_L$ at locations remote from the nozzle opening, which reduces the likelihood of obstructing the nozzle opening with debris carried into the well during cleaning. In an embodiment, the length of the well along the major axis is about 300 to 600 micron, while the width of the well across the minor axis is about 50–70 microns. In other embodiments, the nozzle openings have non-circular geometries that match or do not match the geometry of the well. In addition, the nozzle opening can be offset from the center of the well. In embodiments, the well depth can vary between the nozzle opening and the location in which the perimeter of the well meets the nozzle plate.

The well and/or the nozzle opening can be formed by machining, laser ablation, or chemical or plasma etching. The well can also be formed by molding, e.g. a plastic element. The well and nozzle opening can be formed in a common body or in separate bodies that are assembled. For example, the nozzle opening is formed in a body that defines other components of an ink flow path and the well is formed in a separate body which is assembled to the body defining the nozzle opening. In other embodiments, the well, nozzle opening, and pressure chamber are formed in a common body. The body can be a metal, carbon or an etchable material such as silicon material, e.g. silicon or silicon dioxide. Forming printhead components using etching techniques is further described in U.S. Ser. No. 10/189,947, filed Jul. 3, 2002, and U.S. Ser. No. 60/510,459, filed Oct. 10, 2003, the entire contents of each are hereby incorporated by reference. In embodiments, the well can include a non-wetting coating.

Still further embodiments follow. For example, while ink can be jetted in a printing operation, the printhead system can be utilized to eject fluids other than ink. For example, the deposited droplets may be a UV or other radiation curable material or other material, for example, chemical or biological fluids, capable of being delivered as drops. For example, the apparatus described could be part of a precision dispensing system. The actuator can be an electromechanical or thermal actuator. The well arrangements can be used in combination with other waste fluid control features such as apertures described in U.S. Ser. No. 10/749,829, filed Dec. 30, 2003, now U.S. Published Patent Application No. 20050146569, projections as described in U.S. Ser. No. 10/749,816, filed Dec. 30, 2003, now U.S. Published Patent Application 20050146561 and/or channels as described in U.S. Ser. No. 10/749,833, filed Dec. 30, 2003, now U.S. Published US20050140747. For example, a series of projections or a channel can be included inside the well or on the nozzle face proximate the well, e.g., surrounding the well. An aperture can be provided in the well or on the nozzle face. The fluid control structures can be combined with a manual or automatic washing and wiping system in which a cleaning fluid is applied to the nozzle plate and wiped clean. The cleaning structures can collect cleaning fluid and debris rather than jetted waste ink.

Still other embodiments are within the scope of the following claims.

What is claimed is:

1. A method of fluid drop ejection, comprising: providing a printhead including a fluid flow path in which fluid is pressurized to eject drops from a nozzle opening, the nozzle opening being disposed in a well, supplying fluid to the well from the nozzle opening to form a meniscus, the meniscus defining a fluid depth above the edge of the nozzle opening equal to about 1 to 15% of the nozzle opening width with the well filled with fluid.

2. The method of claim 1 comprising forming the meniscus by controlling the pressure in the fluid.

3. The method of claim 1, comprising forming the meniscus by reducing the pressure in the fluid.

4. The method of claim 3 comprising applying a vacuum at a location upstream of the nozzle opening.

5. The method of claim 4 wherein the vacuum at the nozzle opening is about 0.5 to 10 inwg.

6. The method of claim 1 wherein the ratio of the well width to the nozzle opening width is about 1.4 to about 2.8.

7. The method of claim 1 wherein the well has a depth of about 0.15 to 0.5 of the nozzle opening.

8. The method of claim 1 wherein the spacing between well perimeter and nozzle perimeter is about 0.2 or more of the nozzle width.

9. The method of claim 1 wherein the fluid has a surface tension of about 20–45 dynes/cm.

10. The method of claim 1 wherein the nozzle opening and the well are defined by a common body.

11. The method of claim 1 wherein the nozzle opening and/or the well are defined in silicon material.

12. The method of claim 1 wherein the nozzle and/or the well are defined in a metal.

13. The method of claim 1 wherein the nozzle and/or the well are defined in carbon.

14. The method of claim 1 wherein the nozzle and/or well are defined in a plastic.

15. The method of claim 1 wherein the fluid is pressurized by a piezoelectric element.

16. The method of claim 1 wherein the nozzle opening width is about 70 micron or less.

17. The method of claim 1 including a plurality of nozzle openings, the nozzle openings having a pitch of about 25 nozzles/inch or more.

18. The method of claim 1 including ejecting drops having a volume of about 1 to about 70 pL.

19. The method of claim 18 wherein the fluid is pressurized by a piezoelectric element.

20. The method of claim 18 wherein the nozzle opening has a diameter of about 70 micron or less.

21. The method of claim 20 wherein the well is an oval.

22. The method of claim 18 including a plurality of nozzle openings, the nozzle openings being a pitch of about 100 nozzles/inch or more.

23. The method of claim 1 wherein the meniscus is concaved with respect to the nozzle opening.

24. The method of claim 23 comprising forming the meniscus by controlling the pressure at the meniscus.

25. The method of claim 23 comprising forming the meniscus by reducing the pressure in the fluid.

26. The method of claim 25 comprising applying a vacuum at a location upstream of the nozzle opening.

27. The method of claim 25 wherein the vacuum at the nozzle opening is about 0.5 to 10 inwg.

28. The method of claim 23 wherein the ratio of the well width to the nozzle opening width is about 1.4 to about 2.8.

29. The method of claim 23 wherein the well has a depth of about 0.15 to 0.5 of the nozzle opening.

30. The method of claim 23 wherein the spacing between well perimeter and nozzle perimeter is about 0.2 or more of the nozzle width.

31. The method of claim 23 wherein the fluid has a surface tension of about 20–45 dynes/cm.

32. The method of claim 23 wherein the nozzle opening and the well are defined by a common body.

33. The method of claim 23 wherein the nozzle opening and/or the well are defined in silicon material.

34. The method of claim 23 wherein the nozzle and/or the well are defined in a metal.

35. The method of claim 23 wherein the nozzle and/or the well are defined in carbon.

36. The method of claim 23 wherein the nozzle and/or well are defined in a plastic.

37. The method of claim 23 wherein the fluid is pressurized by a piezoelectric element.

38. The method of claim 23 wherein the nozzle opening width is about 70 micron or less.

39. The method of claim 23 including a plurality of nozzle openings, the nozzle openings having a pitch of about 25 nozzles/inch or more.

40. The method of claim 23 including ejecting drops having a volume of about 1 to about 70 pL.

* * * * *